United States Patent [19]

Jungkind

[11] 4,035,001

[45] July 12, 1977

[54] HEEL TIGHTENER FOR SAFETY SKI-BINDINGS

[75] Inventor: Roland Jungkind, Garmisch-Partenkirchen, Germany

[73] Assignee: Hannes Marker, Garmisch-Partenkirchen, Germany

[21] Appl. No.: 653,115

[22] Filed: Jan. 28, 1976

[30] Foreign Application Priority Data

Feb. 7, 1975 Germany ..... 2505312

[51] Int. Cl.[2] ..... A63C 9/08

[52] U.S. Cl. ..... 280/626

[58] Field of Search ..... 280/626, 623

[56] References Cited

U.S. PATENT DOCUMENTS

| | | | |
|---|---|---|---|
| 3,249,365 | 5/1966 | Beyl | 280/626 |
| 3,466,057 | 9/1969 | Dobler | 280/626 |
| 3,532,352 | 10/1970 | Lusser | 280/626 |
| 3,970,326 | 7/1976 | Salomon | 280/626 |

*Primary Examiner*—Robert R. Song
*Attorney, Agent, or Firm*—Fleit & Jacobson

[57] ABSTRACT

In a heel tightener for safety ski-bindings, a pusher member is movable away from the ski along the tension members against the force of at least one spring and a tightening lever is mounted to pivot about a transverse axis, the free end of the lever being engageable in the groove of the heel and pivotable upwardly into a heel releasing position. A counterbearing is provided to limit downward pivoting of the tightening lever into the clamping position. The tightening lever is secured in the clamping position by locking means which are released after movement of the pusher member by a predetermined distance away from the ski. The locking means comprise a lever arm linkage disposed between the pusher member and the tightening lever axially parallel to the latter, and a locking lever for the bell crank lever, which locking lever is pivotably mounted in the pusher member against the action of spring force.

5 Claims, 3 Drawing Figures

HEEL TIGHTENER FOR SAFETY SKI-BINDINGS

The invention relates to a heel tightener for safety ski-bindings, in which two tension members that are fixed directly or indirectly to the ski and pass along each side of the heel of the boot carry a pusher member movable away from the ski along the tension members against the force of at least one spring and on which a tightening lever is mounted to pivot about a transverse axis, the free end of the lever being engageable in the groove of the heel and pivotable upwardly out of the plane of the tension members into a heel-releasing position, wherein a counterbearing is provided to limit downward pivoting of the tightening lever into the clamping position and wherein the tightening lever is secured in the clamping position by locking means which are released after movement of the pusher member by a predetermined distance away from the ski.

Numerous forms of such heel tighteners are known, for example form German Specification No. 2,406,762. In all such constructions, the lock for the tightening lever is formed by a simple pusher member which is mounted in the locking lever and which has a tongue that engages over a cross-member of the tightening lever in the clamping position. By holding the locking lever back relatively to the pusher member when it abuts against a stop connected to the tension members, locking of the tightening lever can be deliberately released so that the ski boot is freed for example upon the occurrence of corresponding frontal loading.

However, since such loadings are intended to release the locking means only if the leg of the skier is in danger, the locking means have to be dimensioned to be sufficiently strong in order to transmit high but nevertheless permissible forces. This involves the use of excessive material and causes considerable wear of the intensively loaded components that rub on one another. In addition, the high frictional forces give rise to some uncertainty with regard to the values at which release is to take place.

It is therefore an object of the present invention to construct the locking means so that the heel tightener is lighter in weight but nevertheless more durable so that it will be functionally operative for a longer period.

According to the invention, the locking means comprise a lever are linkage disposed between the pusher member and the tightening lever axially parallel to the latter, and a locking lever for the lever arm linkage, which locking lever is pivotably mounted in the pusher member against the action of a spring force. In the tightening position, the lever arm linkage subtends a very acute angle so that a very small force component acts on the locking lever, which therefore permits it to be weakly dimensioned and the use of a small spring loading.

A particularly compact construction is obtained if the locking lever is disposed axially parallel to the lever arm linkage and if the two arms of the lever arm linkage are of different lengths, the shorter arm being hinged to the tightening lever.

Preferably, the locking lever is angular and its second arm is in the form of an opening handle. For the purpose of deliberately opening the heel tightener, the small loading of the locking lever now permits the exertion of a correspondingly low force, which is of importance to a large circle of skiers.

Finally, the locking lever may be coaxial with the tightening lever, this being instrumental for a further reduction of material and in the weight of the heel tightener.

An example of the invention will now be described with reference to the accompanying drawings, wherein.

Figure 1:
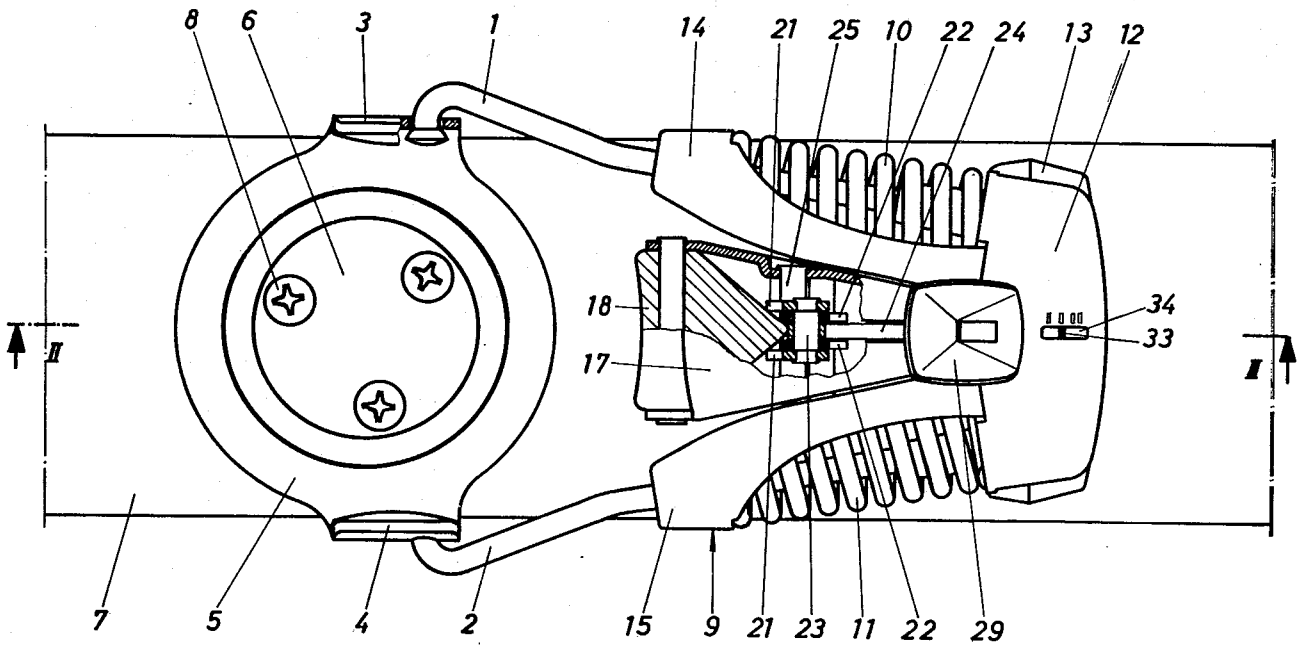
FIG. 1 is a plan view of the heel tightener in the clamping position, the ski boot being omitted.

The illustrated heel tightener which forms a safety ski binding together with a conventional front jaw (not shown) comprises two tension bars 1, 2, one running along each side of the heel of the boot. The tension bars are suspended in respective holes of upwardly flanged side walls 3, 4 of a rotary plate 5. This plate is rotatably mounted on the ski 7 by a retaining disc 6 which is fixed to the ski by three screws 8.

The two tension bars 1, 2 carry a pusher member 9 which is movable away from the ski 7 along the tension bars against the force of two compression springs 10, 11. Each compression spring is placed over a respective one of the tension bars and supported against an abutment at the end of the bar. The two ends of the bars are interconnected by a cross-member 12. Screwed to the end of the pusher member 9 there is a buffer 13 (see FIGS. 2 and 3) which consists of elastic material and by means of which the pusher member is supported on the surface of the ski when a boot is not disposed in the binding.

The pusher member 9, which is substantially U-shaped in plan (see FIG. 1), carries a tightening lever 17 on a shaft 16 between its limbs 14, 15. The free end of the tightening lever carries a pressure member 18 for engagement in the groove of the heel of the ski boot 19 that is shown in chain-dotted lines in FIG. 3. In the clamping position of FIG. 3, the tightening lever lies substantially in the plane of the tension bars 1, 2. FIG. 2, however, shows the heel tightener in the releasing position in which the tightening lever is pivoted upwardly relatively to the tension bars under the influence of a spring 20 (FIGS. 2 and 3) that is coiled on the shaft 16.

The tightening lever 17 is held in the clamping position relatively to the pusher member 9 with the aid of locking means comprising a lever arm linkage comprising first and second lever arms 21, 22 interconnected by pivot 23 and a locking lever 24. The shorter of the two lever arms 21, 22 interconnected by the pivot 23 is hinged to the tightening lever 17 by a shaft 25. The arm 22 is hinged to the pusher member 9 by means of a shaft 26. The two shafts 25, 26 lie parallel to the pivotal shaft 16 of the tightening lever. The tightening lever is formed from a U-shaped sheet metal stamping between the two limbs of which the locking lever 24 is mounted on the shaft 16. A further spring 27 which is likewise coiled on the shaft 16 tends to hold the locking lever in its clamping position. The locking lever is in the form of an angular lever. Its second arm 28 extends outwardly through a slot in the web of the U-shaped tightening lever 17 and serves as an opening handle for deliberately opening the heel tightener. For this purpose, its free end carries a dished sheet metal member 29 on which a force can be applied by a finger or with the tip of the ski stick.

Figure 2:
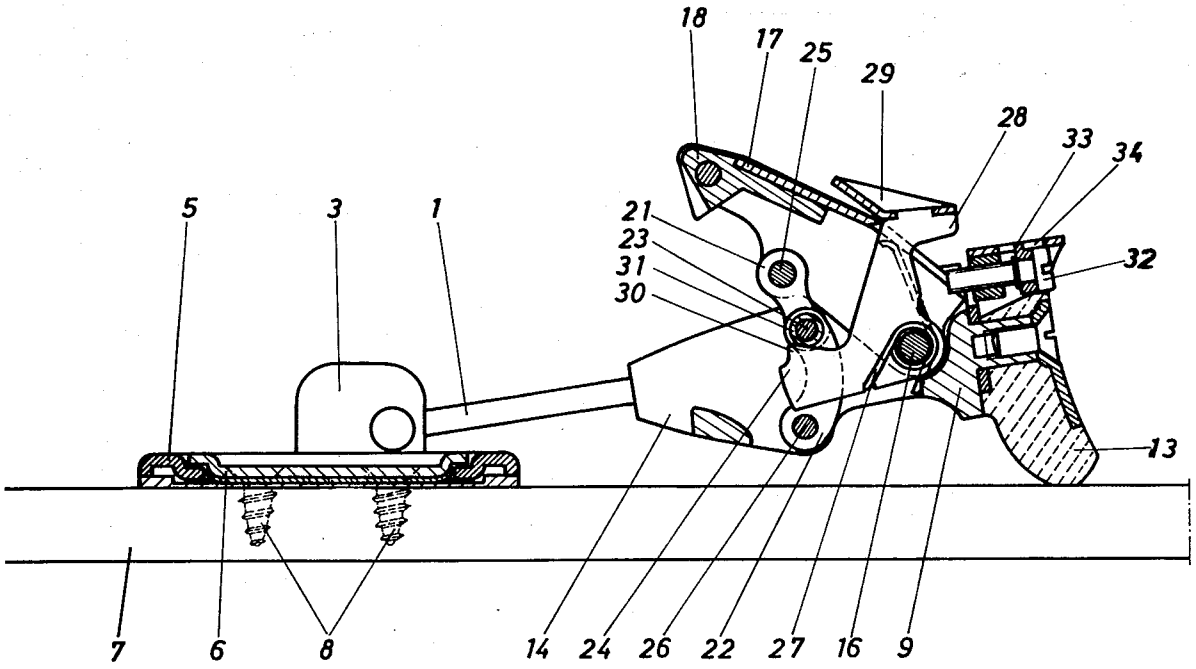
FIG. 2 is a section on the line II—II in FIG. 1 but with the heel tightener shown in the heel-releasing position.

For constructional reasons, each arm 21, 22 of the lever arm linkage consists of congruent parts disposed symmetrically to the medial vertical plane in which the locking lever 24 is located (see FIG. 1).

Figure 3:
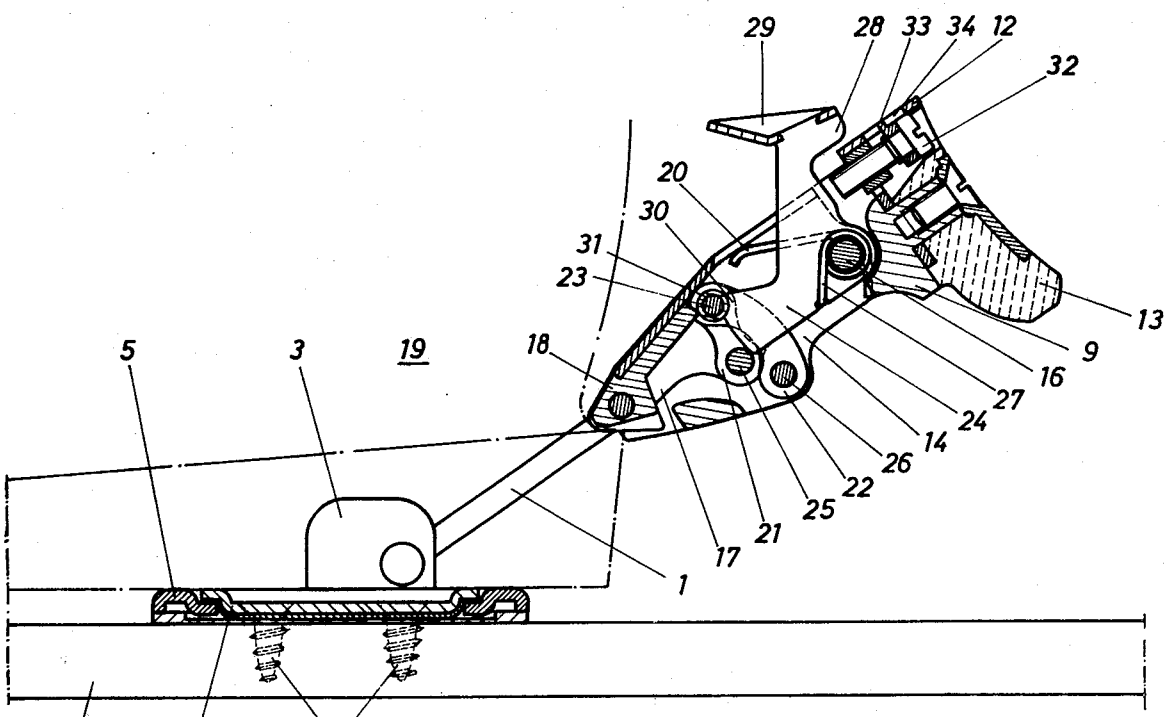
FIG. 3 is a section corresponding to FIG. 2 but in the clamping position and with the ski boot being indicated in chain-dotted lines.

In the clamping position (FIGS. 1 and 3), the locking lug 30 of the locking lever 24 holds the pin or shaft that forms the pivot 23 of the lever arm linkage in the position shown in FIG. 3. This pin carries a runner ring 31 for co-operating with the locking lever.

The pressure member 18 converges inwardly (see FIG. 1) to form a tip against which the runner ring 31 abuts in the clamping position, so that in this way a counterbearing is formed for limiting the pivotal motion of the tightening lever 17 in the downward direction.

In relation to FIG. 3, release of the heel tightener takes place by releasing the tightening lever 17. Such release is effected deliberately by pressing on the handle 28, 29 whereby the locking lug 30 of the locking lever 24 is released from the runner ring 31 of the lever arm linkage pivot so that the lever arm linkage lever can move to its extended position (FIG. 2) under the influence of the loaded tightening lever 17. Automatic release, i.e. in the performance of the safety function, takes place after predetermined movement of the pusher member 9 relatively to the tension bars 1 and 2 and the cross-member 12 connecting same. This occurs in that the arm 28 of the locking lever 24 runs up against an abutment 32 held on the cross-member and thereby disengages the locking lug 30 from the runner ring 31. The abutment 32 is formed by a screw which can be turned further in or out so that the motion of the pusher member up to the point of release and thus the force upon release can be varied. To indicate the set releasing force, the screw 32 carries a rotatable but axially fixed pointer 33 which extends in a slot 34 of the cross-member 12. One edge of the slot is used as an indicator scale (see FIG. 1).

Referring to FIG. 2, closing of the heel tightener takes place after insertion of the toe of the ski boot in the front jaw (not shown) and after lowering of the heel of the boot onto the rotary plate 5 by lifting the heel tightened, inserting the pressure member 18 of the tightening lever 17 in the groove of the heel of the boot 19, and subsequently pulling the heel tightener upwardly at its rear end, e.g. at the buffer 13, until the tightening lever strikes its counterbearing and the locking means snap closed.

I claim:

1. A heel tightener for safety ski-bindings, comprising two tension members fixed directly or indirectly to the ski, each tension member adapted to pass along each side of a boot heel, a pusher member movable away from the ski along the tension members against the force of at last one spring, a transverse shaft connected to said pusher member, a tightening lever mounted to and pivotable about said transverse shaft, the tightening lever having a free end for engagement in the groove of a boot heel when in a clamping position and pivotable upwardly out of the plane of the tension members into a heel-releasing position, a counterbearing means for limiting the downward pivoting of the tightening lever into the clamping position, locking means for securing the tightening lever in its clamped position and for releasing the tightening lever after movement of the pusher member a predetermined distance away from the ski, wherein said locking means comprises first and second lever arms pivotally connected to each other at their ends, the opposite end of said first arm pivotally connected to said tightening lever, the opposite end of the second arm pivotally connected to said pusher member, and a locking lever means for retaining the first arm in a first position, said locking lever means pivotably mounted to said pusher member, and spring means for maintaining said locking lever means in its clamped position.

2. A heel tightener according to claim 1, wherein said locking lever means comprises a locking lever disposed parallel to said first and second lever arms.

3. A heel tightener according to claim 1 wherein said first lever arm is shorter than said second lever arm.

4. A heel tightener according to claim 1 wherein said locking lever means comprises a locking lever having a pair of locking lever arms angularly disposed, wherein one of said locking lever arms comprises a handle means for releasing the tightening lever.

5. A heel tightener according to claim 1 wherein said locking lever means is pivotably mounted to said transverse shaft.

* * * * *